US007956542B2

(12) United States Patent
Matsuzaki et al.

(10) Patent No.: US 7,956,542 B2
(45) Date of Patent: Jun. 7, 2011

(54) EXTERNAL ELECTRODE FLUORESCENT LAMP AND MANUFACTURING METHOD OF THE SAME

(75) Inventors: Ryousuke Matsuzaki, Tokyo (JP); Seiichirou Fujioka, Tokyo (JP); Shin Tanaka, Tokyo (JP)

(73) Assignee: NEC Lighting, Ltd., Tokyo (JP)

( * ) Notice: Subject to any disclaimer, the term of this patent is extended or adjusted under 35 U.S.C. 154(b) by 165 days.

(21) Appl. No.: 12/423,191

(22) Filed: Apr. 14, 2009

(65) Prior Publication Data

US 2009/0267478 A1 Oct. 29, 2009

(30) Foreign Application Priority Data

Apr. 28, 2008 (JP) ..... 2008-117155

(51) Int. Cl.
*H01J 17/44* (2006.01)

(52) U.S. Cl. ..... 313/594; 313/491

(58) Field of Classification Search ..... 313/491, 313/594, 601, 631, 283, 291
See application file for complete search history.

(56) References Cited

U.S. PATENT DOCUMENTS 5,929,564 A * 7/1999 Nakaya et al. ..... 313/607
6,018,218 A * 1/2000 Terada et al. ..... 313/488

FOREIGN PATENT DOCUMENTS

JP 2004-079267 3/2004
JP 2004-179059 6/2004

* cited by examiner

*Primary Examiner* — Vip Patel
(74) *Attorney, Agent, or Firm* — Young & Thompson

(57) ABSTRACT

An external electrode fluorescent lamp includes a glass tube made of soft glass, and external electrodes affixed to outer surfaces of both ends of the glass tube. The fluorescent lamp further includes a joining material applied between at least the glass tube and the external electrodes for affixing the external electrodes, which are made up of a material having a thermal expansion coefficient that is larger than that of the glass tube. According to the manufacturing method of the fluorescent lamp, first, the external electrodes are attached to the outer surface of each end of the glass tube, the external electrodes are then immersed in fused solder, and finally, the glass tube is cooled to room temperature. In this manner, the external electrodes are affixed to the outer surface of the glass tube via soldering.

4 Claims, 1 Drawing Sheet

EXTERNAL ELECTRODE FLUORESCENT LAMP AND MANUFACTURING METHOD OF THE SAME

BACKGROUND OF THE INVENTION

1. Field of the Invention

The present invention relates to an EEFL (External Electrode Fluorescent Lamp) applicable as an LCD backlight or the like, and a manufacturing method of the same.

2. Description of the Related Art

So far, hard glass has traditionally been used for an arc tube of the EEFL, but its low permittivity deters high current flow. Therefore, to allow high current flow for a high efficiency lamp, a recent technology has proposed the use of soft glass (see Japanese Published Patent Application Nos. 2004-79267 and 2004-179059).

However, glass tubes made of soft glass, as described above, have larger thermal expansion coefficients than glass tubes made of hard glass. What happens then to such a glass tube when the conventional electrode material (42 alloys) is used for an external electrode is that a joining material (solder) between the glass tube and the external electrodes does not adhere well to the external electrodes because the electrode material expands or contracts a relatively smaller amount than that of soft glass. That is, it is difficult to firmly affix the external electrode to the glass tube. Consequently, defects like the separation of the external electrode are apt to occur.

SUMMARY OF THE INVENTION

The present invention is therefore intended to provide an external electrode fluorescent lamp (EEFL) to resolve the above problems.

One aspect of the present invention relates to a manufacturing method of EEFL comprising a glass tube made of soft glass, and external electrodes affixed to outer surfaces of both ends of the glass tube.

The fluorescent lamp manufacturing method according to the present invention has the following procedure. First, the external electrodes are prepared from material that has a thermal expansion coefficient larger than that of the glass tube. Next, the external electrodes are attached to the outer surfaces on the ends of the glass tube. The glass tube with the external electrodes attached thereto is then immersed in fused solder. Finally, the glass tube is taken out of the solder bath and cooled to room temperature. In this manner, the external electrodes are affixed to the outer surfaces of the glass tube via soldering.

Another aspect of the present invention relates to an external electrode fluorescent lamp (EEFL) comprising a glass tube made of soft glass, and external electrodes affixed to the outer surfaces of both ends of the glass tube.

The fluorescent lamp according to the present invention comprises a joining material applied between at least the glass tube and the external electrodes for affixing the external electrodes to the glass tube. Moreover, the external electrodes are comprised of material that has a thermal expansion coefficient larger than that of the glass tube.

According to the present invention, the external electrodes can be firmly or securely affixed to the glass tube.

DETAILED DESCRIPTION OF THE EXEMPLARY EMBODIMENT

Figure 1:
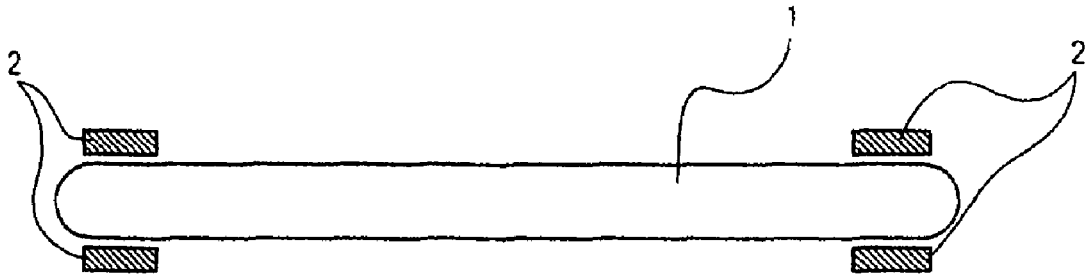
FIG. 1 is a view for explaining an example of how external electrodes are affixed to an external electrode fluorescent lamp (EEFL) in accordance with one embodiment of the present invention.
Figure 2:
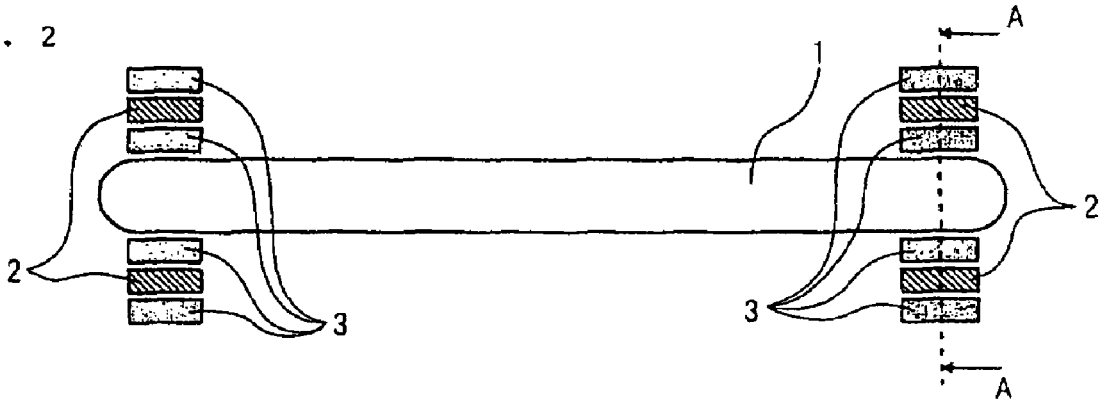
FIG. 2 is a view for explaining another example of how external electrodes are affixed to an EEFL in accordance with one embodiment of the present invention.
Figure 3:
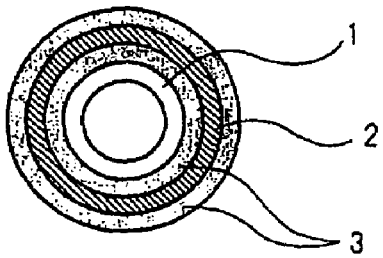
FIG. 3 is a partial cross sectional view taken along line A-A in FIG. 2 of an EEFL made in accordance with the manufacturing method of the present invention.

Referring to FIG. 1 through FIG. 3, an external electrode fluorescent lamp (EEFL) according to one embodiment of the present invention includes glass tube 1 made of soft glass, and external electrodes 2 affixed to the outer surfaces of both ends of glass tube 1.

Also, there is joining material 3 applied between at least glass tube 1 and external electrodes 2 for affixing external electrodes 2 to glass tube 1.

External electrodes 2 consist of material having a thermal expansion coefficient larger than that of glass tube 1 made of soft glass. For example, the soft glass may be soda-lime glass, and the electrodes material may be iron. In addition, solder may be used as joining material 3.

Next, a manufacturing procedure of the EEFL according to one embodiment of the present invention will now be described.

First, external electrodes 2 are prepared. That is to say, an electrode material that has a thermal expansion coefficient larger than that of glass tube 1 is selected. Then the electrode material is formed in a certain shape to be attachable to the outer surfaces of glass tube 1.

The thus prepared external electrodes 2 are attached to the outer surface of each end of glass tube 1.

Glass tube 1 with external electrodes 2 attached thereto is immersed in fused solder of a solder bath. At this time, since external electrodes 2 have a larger thermal expansion coefficient than glass tube 1, a large gap is created between glass tube 1 and external electrodes 2, and a great amount of solder that is used as joining material 3 of the electrode is filled into the gap (see FIG. 2).

Later, glass tube 1 is taken out of the solder bath and cooled to room temperature. In the meantime, external electrodes 2 contract or shrink and compress glass tube 1 moderately, such that external electrodes 2 may be affixed to glass tube 1 with a sufficient amount of solder applied between them.

Therefore, by affixing the external electrodes to the glass tube made of soft glass using the electrode material and the joining material of the electrode described above, a firm and stable connection is attained between the external electrodes and the glass tube.

In addition, solder, which is used as the joining material of the electrode, is preferably prepared with material exhibiting low thermal-expansion and contraction behavior between room temperature and the solder immersion temperature of 250° C. One example of such material is a Sn—Bi based solder (containing 13-40% of Bi by weight).

With external electrodes being firmly affixed to the glass fluorescent tube, the EEFL described above can advantageously be used as a backlight for a liquid crystal display device configured for easy replacement of fluorescent lamps. That is, improved reliability of external electrodes is achieved particularly when the EEFL is disconnected from a voltage-impressing terminal.

What is claimed is:

1. An external electrode fluorescent lamp comprising:

a glass tube made of soft glass;

external electrodes affixed to outer surfaces of both ends of the glass tube; and a joining material applied between at least the glass tube and the external electrodes for affixing the external electrodes, the external electrodes comprising material having a thermal expansion coefficient larger than that of the glass tube.

2. The fluorescent lamp according to claim 1, wherein the joining material comprises a Bi-Sn containing solder.

3. A liquid crystal display device using the external electrode fluorescent lamp set forth in claim 1 as a backlight.

4. A liquid crystal display device using the external electrode fluorescent lamp set forth in claim 2 as a backlight.

* * * * *